US008108966B1

(12) United States Patent
Viviano

(10) Patent No.: US 8,108,966 B1
(45) Date of Patent: Feb. 7, 2012

(54) VACUUM ACOUSTIC CEILING REMOVAL SYSTEM

(76) Inventor: James C. Viviano, Toluca Lake, CA (US)

( * ) Notice: Subject to any disclaimer, the term of this patent is extended or adjusted under 35 U.S.C. 154(b) by 649 days.

(21) Appl. No.: 12/217,992

(22) Filed: Jul. 9, 2008

Related U.S. Application Data

(60) Provisional application No. 60/959,112, filed on Jul. 10, 2007.

(51) Int. Cl.

| | |
|---|---|
| ***A47L 5/00*** | (2006.01) |
| ***A47L 9/06*** | (2006.01) |
| ***A47L 13/02*** | (2006.01) |
| ***A47L 17/06*** | (2006.01) |
| ***A47L 23/22*** | (2006.01) |
| ***B25G 1/10*** | (2006.01) |

(52) U.S. Cl. ..... 15/401; 15/236.01; 16/430

(58) Field of Classification Search ..... 15/401, 15/236.01, 402, 93.1; 16/110.1–114.1, 405–446
See application file for complete search history.

(56) References Cited

U.S. PATENT DOCUMENTS

| | | | | | |
|---|---|---|---|---|---|
| 712,843 | A * | 11/1902 | Paul | 173/30 |
| 2,820,290 | A * | 1/1958 | Porter, Jr. | 30/136 |
| 3,336,617 | A * | 8/1967 | Bosko et al. | 15/146 |
| 4,179,805 | A * | 12/1979 | Yamada | 30/122 |
| 4,207,674 | A * | 6/1980 | Heronema | 30/169 |
| 4,888,846 | A * | 12/1989 | Natale | 15/236.01 |
| 5,021,095 | A * | 6/1991 | Tamaki | 134/21 |
| 5,047,089 | A * | 9/1991 | Grant | 134/21 |
| 5,529,357 | A * | 6/1996 | Hoffman | 294/58 |
| 5,839,154 | A * | 11/1998 | Kawai et al. | 15/320 |
| 6,149,252 | A * | 11/2000 | Browning | 312/1 |
| 6,467,124 | B1 * | 10/2002 | Small | 15/401 |
| 7,802,342 | B2 * | 9/2010 | Cowan et al. | 15/322 |
| 2002/0157215 | A1 * | 10/2002 | Carman et al. | 16/430 |
| 2004/0196156 | A1 * | 10/2004 | Wilker et al. | 340/691.1 |
| 2005/0172432 | A1 * | 8/2005 | Sullivan | 15/105 |
| 2008/0023032 | A1 * | 1/2008 | Cowan et al. | 134/6 |

* cited by examiner

*Primary Examiner* — Bryan R Muller
(74) *Attorney, Agent, or Firm* — Stan Jones, Patents

(57) ABSTRACT

A ceiling tool assembly has a unique ergonomically curved handle supported by a user at its rearward end with a cantilever rocker-shaped arm and forwardly slanted pistol grip. A curved concave surface conforms to the underarm part of a user's forearm above the elbow and further includes a forwardly slanted pistol grip with stub extension and an upward handle offset bend. Scraping force is provided by handle shape and handle attachments of my scraping unit for easy removal of popcorn from an overhead ceiling. A forearm resting area allows the user to provide either a right handed or left handed lifting force to the scraper unit. The offset portion, provided at the mid point of the handle, together with a handle attachment/design allows a two arm back and forward scraping force to be exerted along the length of the scraper unit.

7 Claims, 5 Drawing Sheets

VACUUM ACOUSTIC CEILING REMOVAL SYSTEM

BACKGROUND OF THE INVENTION

This is a regular patent application that is being timely filed within the time period allotted from a Provisional Application Entitled Vacuum Acoustic Ceiling Removal System as filed on Jul. 10, 2007 having the same inventor as hereof and awarded Ser. No. 60/959,112. VACRS™ stands for Vacuum Acoustic Ceiling Removal System. As noted in the provisional application, this is an adopted Trademark designated for the blade and hopper portion of the system. The handle, being capable of supporting more than one ceiling treatment tool, has been named a Hi Pro Tool as an adopted trademark soon to be seen on Applicant's hiprotool.com web site.

FIELD OF THE INVENTION

This invention relates to a ceiling treatment tool that is primarily useful for modernizing your home/office. Both a tool apparatus and a method of tool use for removing "popcorn" or "cottage cheese" from ceilings are presented. More specifically, the field of this invention relates to a vacuum assisted ceiling scraper system that will more readily and safely remove what is today called a "dreaded" acoustic ceiling covering. Additionally, the field of this invention relates to a hand held vacuum assisted ceiling tool for acoustic ceiling removal that greatly eases the tasks and does so with increased safety and convenience in comparison to manual ladder and hand held scraping trowels of the prior art.

Explanation of Terms.

Set out below are brief descriptions of certain relevant terms which further the understanding of the invention. These terms provide a basis for a detailed teaching of the improvements of this invention in the relevant arts. Such terms are not intended to replace the claims but rather serve as helpful guides in understanding my novel improvement in this art.

Acoustic Ceiling Covering.

According to the National Association of Home Builders, acoustic ceilings were the latest things in the 1950s and then inevitably fell out of favor. Whether it was originally featured as a noise deterrent or as a way of concealing imperfections in a large ceiling expanse, the "popcorn" look was at one time the "in" thing to do. Today it is hopelessly outmoded and is a sure sign of a dated appearance. With today's modern look to decorating, such ceilings simply have to be removed to give a home or office a more modern appearance. Like and old bath or old kitchen, the "popcorn" look simply has to go for modernization purposes. Removing such acoustic ceiling coverings, however, is not an easy thing at all. While working at floor level has gravity as an aid, ceiling work turns all that upside down and presents many unique challenges.

Asbestos Binder Material.

One of the first things that must be done in acoustic ceiling removal is to determine if the acoustic material includes asbestos. If the structure was built before 1979 the chances are pretty good that the ceiling binder used was an asbestos material. Even into the 1980s, and later on, the ceiling material may still be asbestos, since such ceilings were exempt from the 1979 ban on the use of asbestos. Testing laboratories are available for testing samples removed from the ceiling for the presence of asbestos. If asbestos is present, the principles of this invention may still be of great assistance when attached to a HEPPA™ Vacuum System.

Nevertheless, professional advice should be employed since asbestos removal involves special filter respirators, disposable protective clothing and special containment bags for holding all the debris that is removed. While not suggesting any violation of the asbestos prohibition laws, this invention is deemed of great assistance because of the ease and safety for treating ceilings as provided by the invention.

Scraper Blade & Collection.

A scraper blade assembly is built into—or fastened onto—a hopper mounted at the upper end of a uniquely curved handle that is supported by the user and used to scrape acoustic material from a ceiling being treated. A scraper blade and collector is one of several ceiling tools that may be attached at the forward end of the unique supporting handle of this invention. In my invention, the handle—at its end nearest the user—includes a curved cantilever arm rest and an ergonomic handle grip. A curved concave surface at the handle end is shaped in such a manner that it conforms to the underarm part of a user's forearm above the elbow. That handle end further includes a handle grip which provides both a firm grip and a forearm arm support for the scraper tool. A user may then apply both an upward and transverse scraping force for removal of popcorn from an overhead ceiling.

Two Arm Force.

The handle of the invention provides—in addition to the forearm support end—a side handle grip that allows the user to exert force by one hand, while the forearm support/pistol grip area allows the user to provide additional force by the other hand to the scraper unit. A double bend portion—about forty-five degrees up and then forty five degrees down—is provided at about the mid point of the handle. That double bend provides an upward offset for the handle. Such an offset, together with the handle attachment/design, allows a joint two arms back and forward force to be exerted along the longitudinal length of the unit. A source of vacuum is connected by a length of lightweight vacuum hose to the scraper trough. "Popcorn" from a ceiling may thus be removed and contained in an easy and efficient manner by using this invention.

Tool Adjustability.

Additional features for the ceiling tool includes a means for adjusting either the blade per se or the entire collector tray, or trough, as they contact the ceiling for scraping. In the case of the blade it may be flexible and may be seated in any one of several adjustment slots for fine adjustments that allow small variations in the angle of attack by the blade against the ceiling. Additionally, adjustable skid plates mounted on the collector tray itself do several things. They immediately position the unit at the preferred angle when lifted aloft and placed against the ceiling. Being adjustable in a simple manner, such plates allow the user to further trim the angle of attack for the tray unit itself by a simple adjustment to the skid plate position. The forward part of the handle telescopes for height adjustments during tool use.

Additional VACRS™ Capabilities.

VACR is basically a multifunctional ceiling tool which provides a multitude of uses and structural variety, all of which readily stem from its basic novelty. For example, in acoustic ceiling removal, as explained more herein, it is often better to moisten and then let a mist of moisture "set" on the acoustic covering before scraping and collection. Such misting may readily be achieved by a set of water spraying tips positioned at the upper end of the handle of the invention. Additionally, the ceiling treatment may involve some power attachments that also are readily within the scope of the novel concepts disclosed and claimed herein.

Thus, electrical, cordless battery, lithium Ion, air or water supply connections to the tip of the handle may be utilized to energize any suitable power driven attachments. Such attachments may include, for example, a window brush, scrub and squeegee, sand blasting, power washing, paint roller and sleeve, ceiling tape and/or paper dispenser and similar such attachments. The novel configuration of the unique two-arm force handle for the invention allows a diverse type of uses and structural attachments to be achieved.

BACKGROUND OF THE INVENTION

Residential and business customers today are very design conscience about their home and office surroundings. Often they want the interior of their homes/offices to be modernized with the latest and sleek looking fashion trends. For some time now, a common practice is to modernize homes that contain what was once considered a trendy feature. Namely, acoustic ceilings.

It is known in the building trades to coat an exposed layer of sheetrock or stucco lattice in a ceiling with a base coat, and then spray on that coating a mixture of acoustic material that has a binding agent mixed therewith. It has often been referred to as a "popcorn" or "cottage cheese" ceiling, since the outward appearance resembles a bumpy layer of popped corn. For some time now, almost every redesign involves removing the popcorn—or acoustic ceiling—so that stucco, paint, or glazes in any number of shades and tones may be used to present a more up to date ceiling treatment.

Acoustic ceiling removal is a messy and potentially hazardous endeavor. It is labor intensive, mostly involving a trowel-like scraper, broom, plastic drop cloths, ladder, sand paper and dust pan and vacuuming equipment. If one uses a misting agent such as water to first soften the popcorn, such an approach may create a glue-like mixture that soon covers the work place and gets all over everything—including hand implements in use. Removal attempts on a dry basis are even a more potentially stringent problem because of the dust, dirt and debris that is created in the air. Some acoustic material may be mixed with asbestos. Breathing such a foul dust, dirt and debris mixture is not healthy, to say the least.

Moreover, this manual prior art approach is also time consuming, very costly and creates health hazards as mentioned above. Estimates for a 15 foot by 20 foot room run about $3,000.00 to $5,000.00 for the labor-intensive ceiling removal work when asbestos is involved. Additionally, it often becomes necessary to attempt to seal off the other rooms in the residence or office to minimize the disruption to the use of the rest of the office/home. Unless one wears some form of a mask and breathing apparatus, there is very little protection from the dust and dirt mixture in the air. All of these factors bring the safety and level of skill of the workers into play.

In short summary, acoustic ceiling removal is a drawn out, dangerous and costly affair. A better way is required, and that better way is presented by this invention which for the first time discloses a new and an improved method and apparatus for acoustic ceiling removal.

BRIEF DESCRIPTION OF THE DRAWING

FIG. 1 is a perspective view of the combination arm and hand supported scraper and collection unit 150 for my VACRS™ approach.

FIG. 4 is a side view of the tray/collector 110, shroud 195 and blade 100 in place during a ceiling scraping action, FIG. 5 is another perspective view that better shows the telescoping feature of the upper section of the handle 140 of FIG. 1, and the transparent material collector shroud 195 in more detail.

SUMMARY OF THE PRESENT INVENTION

A ceiling scraper unit attached to an elongated handle allows a user to reach aloft and scrape acoustic "popcorn" ceiling material from an acoustic ceiling, and contain same via a tray-shaped trough, or hopper, which is connected at the forward end of said handle. The hopper has a scraper blade across a top front upper leading edge. The tray-shaped trough includes a vacuum opening in a lower rearward portion for a vacuum suction to be applied to the interior of said hopper for removal of debris scraped from a ceiling by said blade. The tool's handle includes a cantilever arm rest attachment at the lowest end of the elongated handle which allows a user to apply a two arm ceiling scraping force at said blade location.

The unit includes a concave upper surface at the handle end nearest the user which concave surface is shaped to conform to an underarm area; and located just forward of that concave area, the handle includes a pistol-like grip and a double bend upward offset in the handle. A transparent shroud covers the base of said collector, which transparency allows the user to see and guide the scraper blade during a ceiling scraping maneuver. Proper scraping of a ceiling has a range of preferred angles of attack by the flexible blade and said unit further includes adjustability features for the flexible blade per se and/or for the tray itself. Additionally, skid plates connected to the tray allows the user to apply proper—yet adjustable—angle positioning against the ceiling in a simple efficient manner.

OBJECTS OF THE INVENTION

It is an object of this invention to allow a ceiling treatment operation by a user standing on the floor below in a simple and efficient manner.

It is still a further object of this invention to provide a double bend cantilever handle of sufficient length and novel shape so as to provide lift and scraping and/or other two arm treating forces to be applied to an overhead ceiling by a new and improved ceiling tool.

It is still a further object of this invention to provide a novel tray and collection unit having a transparent shroud covering and a vacuum attachment for ceiling treatment by a user without ladders and hand held devices of the prior art.

DETAILED DESCRIPTION OF THE INVENTION

Figure 1:
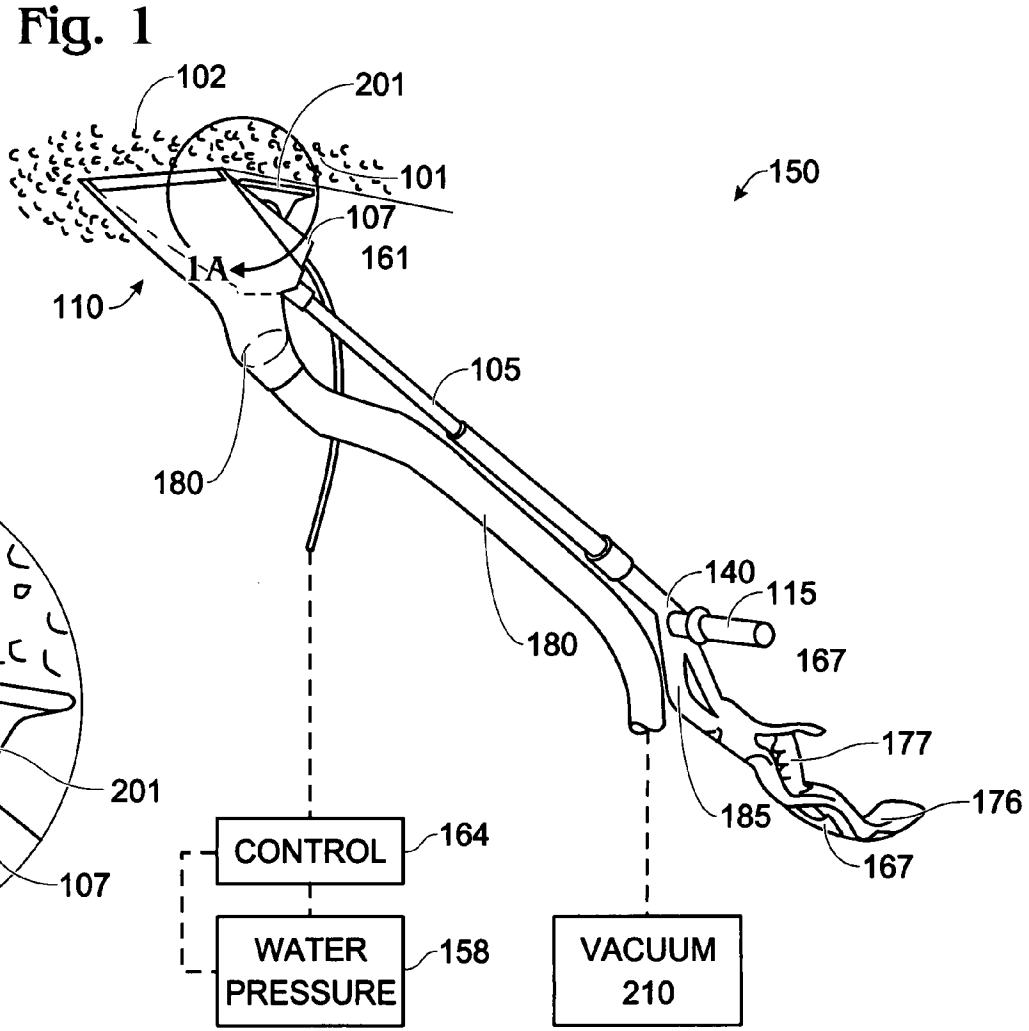
FIG. 1 includes FIG. 1A.
Figure 1A:
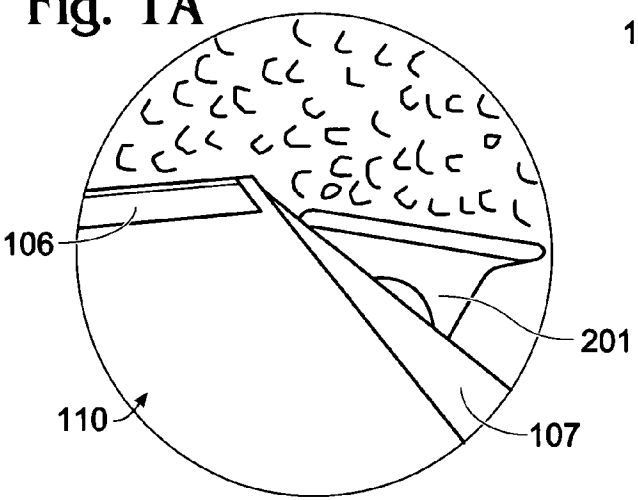
FIG. 1A shows an enlarged view of the blade and skid plates for the hopper.
Figure 5A:
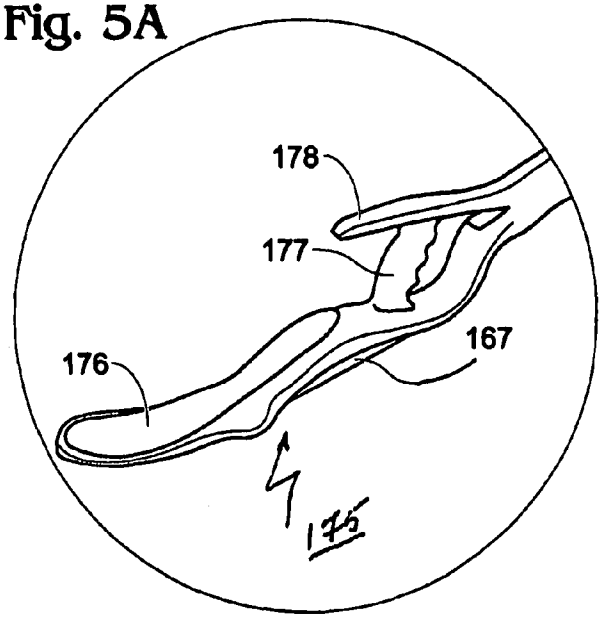
FIG. 5A is an enlarged view of the forward slanted handle and arm rest of the handle for my tool invention.
Figure 5:
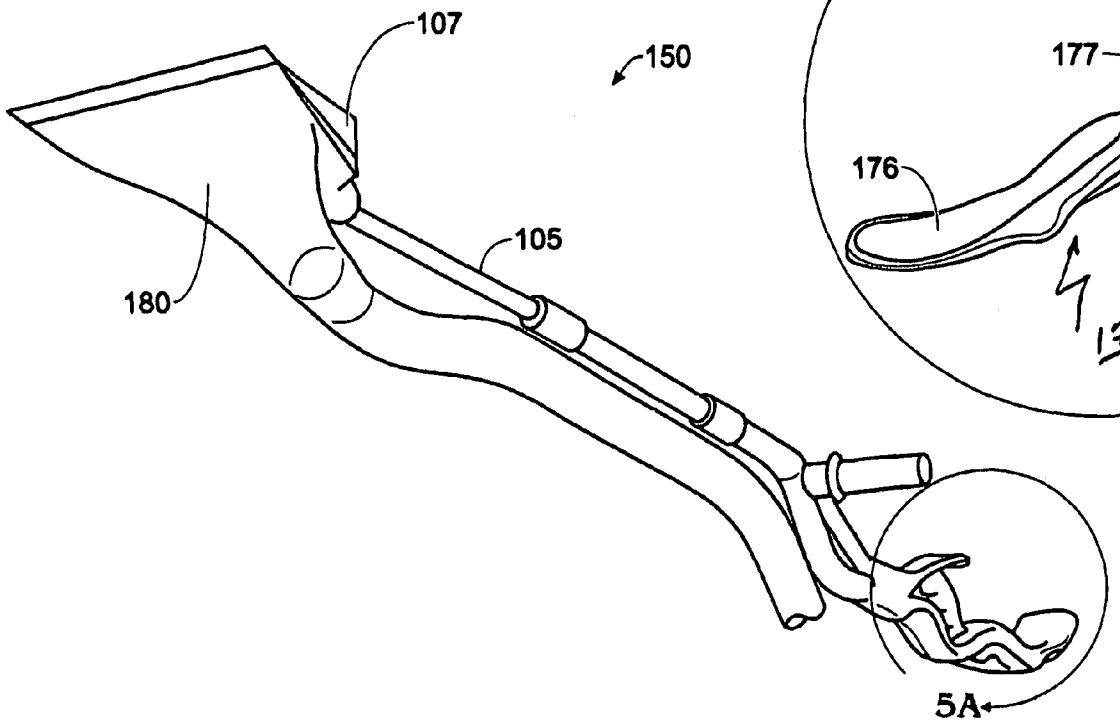
FIG. 5 includes FIG. 5A.

In FIGS. 1 and 5 a scraper blade hopper assembly 110 is built into—or fastened onto handle 140—including the forwardly-located telescope arm 105—which arm extends from a side extension handle 115 and an arm support area 175. A key feature of this invention resides in the overall design of handle 140 that is cantilever supported by the user in order to scrape acoustic material from a ceiling 102 being treated.

FIG. 5A depicts—at a slightly different angle—an enlarged area of the end of handle 150 that is nearest the user. The cantilever nature of the handle is described in more detail hereinafter.

Handle 140 at it rearward end includes a cantilever arm support area 175 with rocker tip 176 a strut 167 and an ergonomic hand grip 177. The upward rocker curvature of the cantilever support 176 and the forward leaning pistol-like hand grip 177 and forward strut 167 together provide a ready-made upward force to hold handle 140 aloft during a ceiling treatment procedure with my VACRS™ system.

Across the top of the closed hand grip area as shown in FIG. 5A is a stub extension 178 which fits within the user's arch joining the thumb and knuckle of the forefinger. As explained further herein, that stub extension 178 contributes to a cantilever holding feature for handle 140. It is defined as a cantilever feature because, in effect, the weld area 178 (where several handle elements join together) acts as a fulcrum point in a fully moveable handle unit.

Returning briefly to FIG. 1, area 175 has, at the rearward end, an upward rocker-shaped curved and concaved surface 176. This surface 176 is shaped to conform to the fleshy underarm part of the user's forearm above the gripping hand. A forwardly slanted handle grip 177 is molded or otherwise fashioned into the handle 140 which is located at the front of the concave rocker surface 176. Elements 176, 177 and 178 together provide for the user a firm grip and lifting support for unit 150. One may think of the area 175 as primarily forming an arm extension of the right arm of the user. That arm extension allows scraping and other ceiling treatment force to be applied to a ceiling.

Figure 2:
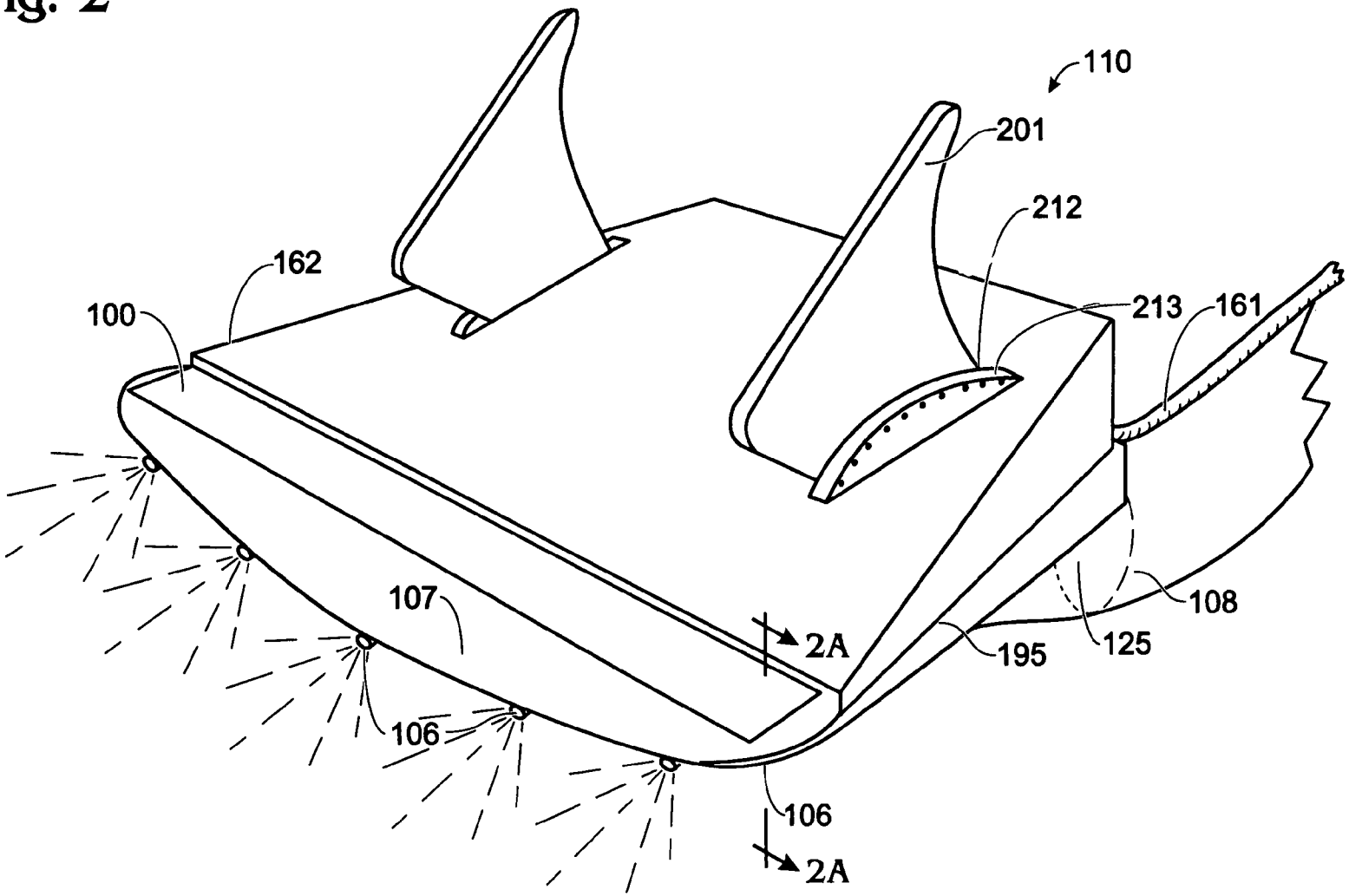
FIG. 2 is a front view of my material collector 107 and vacuum funnel head 195 and includes an enlargement FIG. 2A which depicts a variable adjustment and "set" for blade 100.

At the forefront of the VACRS™ unit—is the scraper blade and hopper assembly 110. A front view looking down shows the material collector and trough 110 in FIG. 2. FIG. 2 clearly shows the scraper blade 100 mounted on the upper leading edge 106 of my scraper and hopper (or trough) assembly 110.

Figure 3:
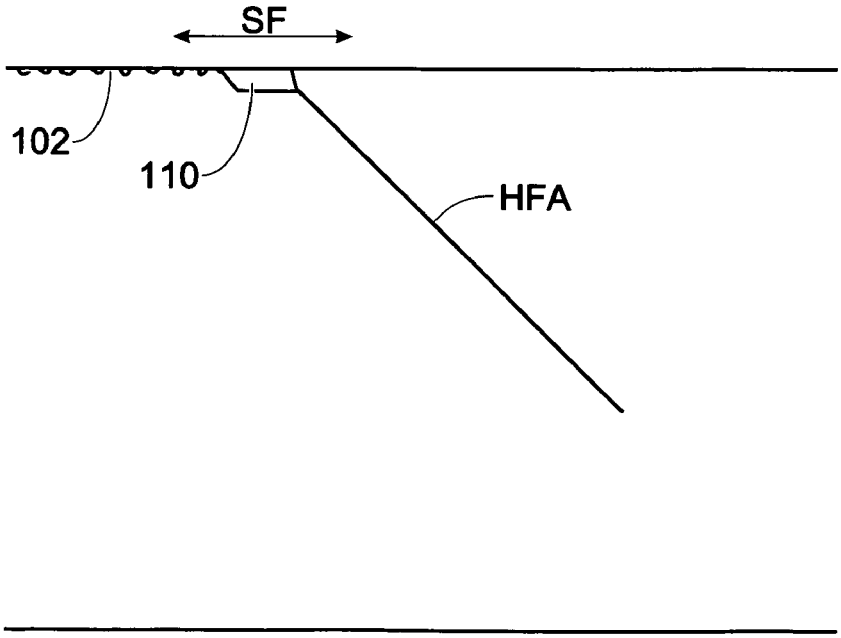
FIG. 3 is a simplified stick view of a ceiling 102 and the removal unit 150 and shows in very simplified form the angle of attack HFA for the handle 140 and the scraper and collector 110 as used during acoustic ceiling removal.

Since the ceiling "popcorn" material which must be removed is several feet away from the user's location on the floor, handle 140 requires both a lifting support to hold it aloft against the ceiling while also providing a way for the user to apply a scraping force SF, FIG. 3, back and forth across the ceiling surface 102 as well. The handle 140 is well designed to give the user such force in a simple and direct manner.

FIG. 3 depicts in simplistic form the handle force axis "HFA" and it also shows—by the two headed arrow—the direction of scraping force "SF" needed for acoustic ceiling scraping. Thus, as shown, both an upward handle force axis HFA and a transverse scraping force SF is required for removal of the popcorn from the overhead ceiling 102, FIG. 3. These FIG. 3 forces are applied to handle 140, FIG. 1, by means of a side handle extension 115 and the arm rest area 175.

Returning again to FIG. 1 side handle 115 (in the left hand side extension position on handle 140 as shown) and pistol hand grip 177, 178 allows the user to exert both a right and a left hand force. Please note also that the forearm resting area 175 and grip 177 allows the user to provide lift while applying both a right handed and left handed force to handle 140. A double bend portion 185 (about 45° upward and about 45° downward) is provided at about the mid point of handle 140. Those bends in handle section 185 provides a generally upward offset to the handle force axis HFA, FIG. 3, applied to handle 140.

Thus, together the double bend 185, handle 115 and arm support area 175 allow a joint two arm back and forward scraping force SF to be exerted along the length of unit 150. (Handle 115 may be unscrewed and reattached on the other side of handle 140 for left arm users). In any event, the scraping force SF is applied to the ceiling 102 in question. Popcorn from ceiling 102 is thus scraped, removed and vacuum contained in an easy and efficient manner by using this invention.

Figure 4:
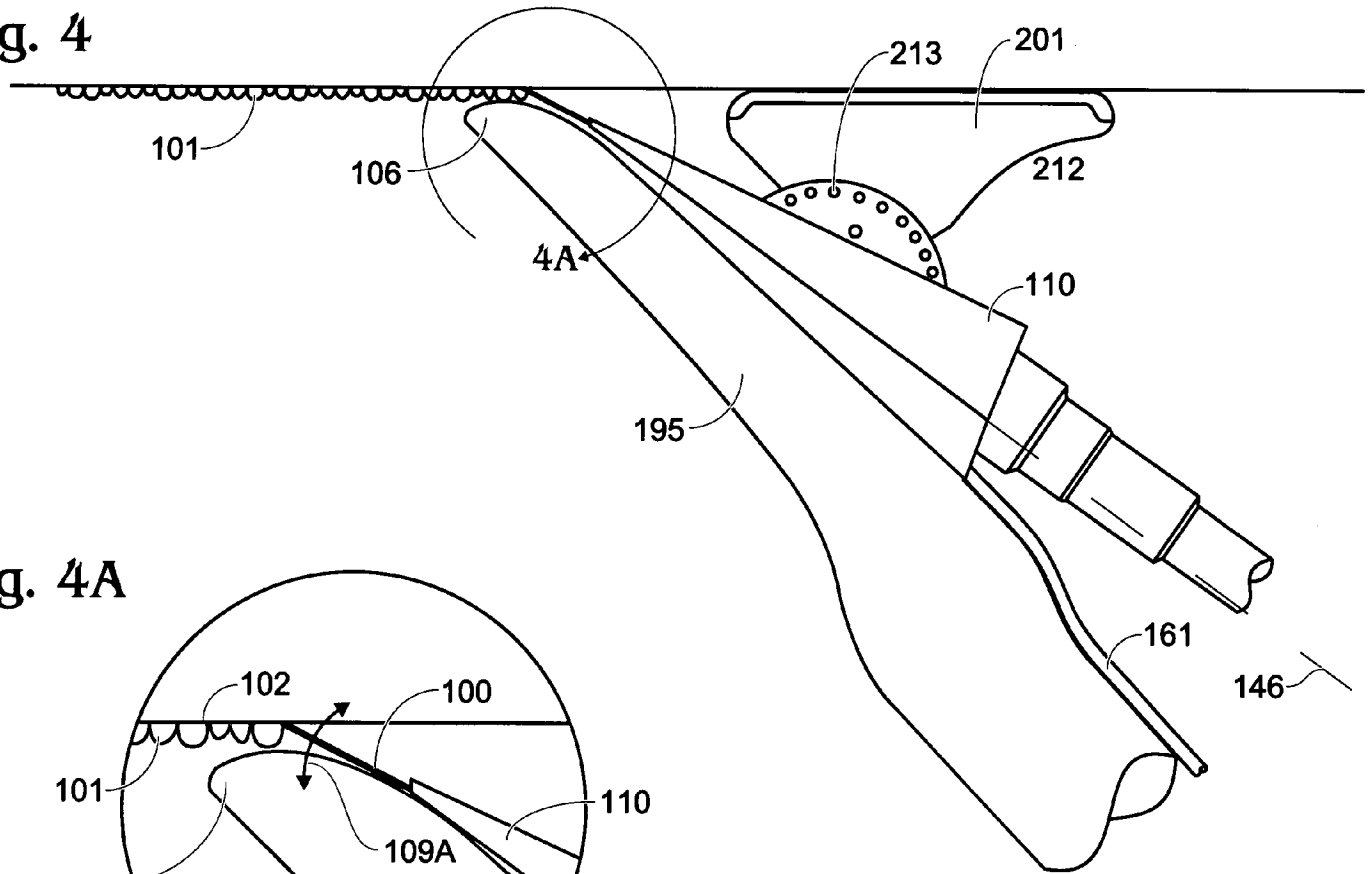
FIG. 4 includes FIG. 4A.
Figure 4A:
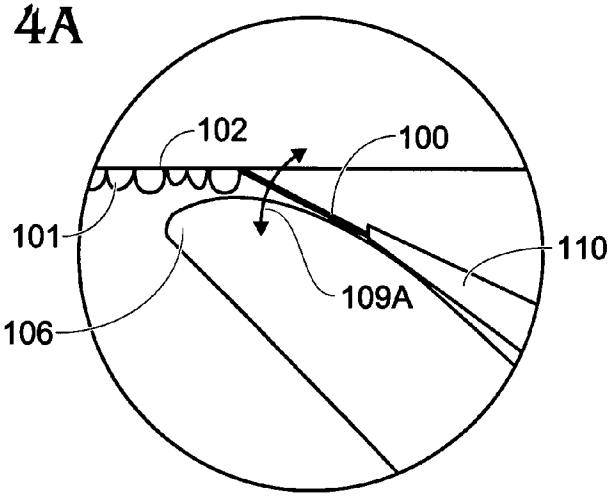
FIG. 4A is an enlarged side view showing the blade during a scraping operation.

FIG. 4 is an important Figure because it includes an enlarged view of FIG. 4A that demonstrates the scraper blade 100 held at about 32.5 to 33 degrees as a preferred angle of attack HFA for the scraper unit 150. Quite obviously the preferred degree is an approximation in the range of about 30 to 38 degrees since it need not be precisely that as shown. Skid plates 201 allow the user to achieve a preferred angle of attack. Also skid plates via 212 and 213 are adjustable so that scraping angle can be varied as needed for any particular job.

What is important to note, however, in FIG. 4A is that the blade 100 is at an angle to ceiling 102 and is scraping away popcorn 101 even as the crowned roll 106 of the shroud 195 is not in direct contact with the acoustic material 101 to be removed. FIG. 4A may be considered as an enlarged cross sectional view taken down the main line of force HFA along the longitudinal force axis 146 of handle 140, FIG. 4.

Figure 2A:
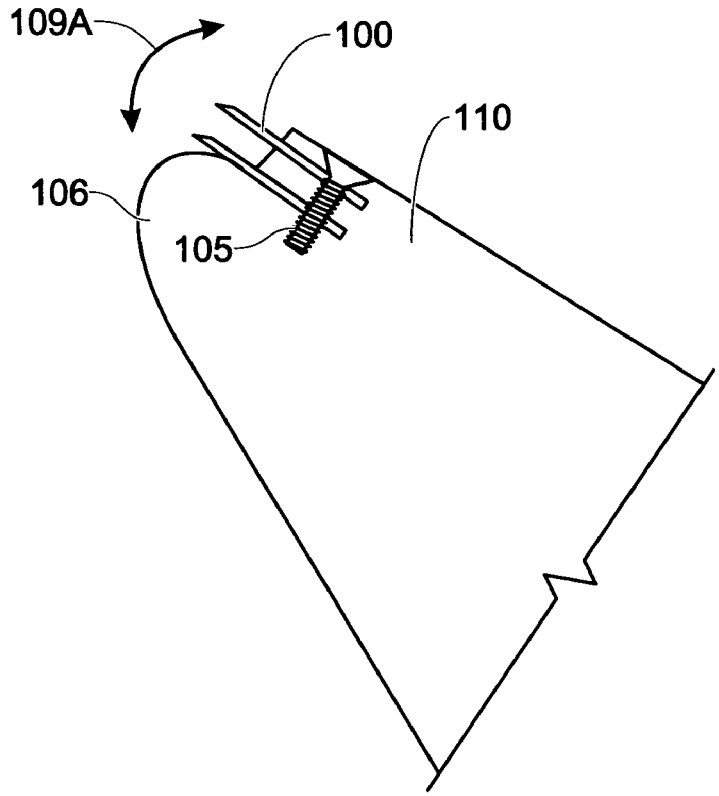

As shown in FIG. 2A and FIG. 4A, blade 100 may be positioned to lead slightly forward of the rolled crown edge 106 while the hopper 195 is in position to catch and collect the scraped-away acoustic popcorn "kernels" 101, FIG. 4A. It only requires a pass or two for the user to ascertain the best angle of attack HFA (FIG. 3) for removing popcorn 101 from ceiling 102.

Blade 100 is a flexible blade that may be adjustable in the actual angle relative to the crown 106 which holds blade 100 in place. This adjustability feature 109 is demonstrated by the double headed arrow 109A in the enlargement of FIGS. 2A and 4A and may simply be achieved by a vernier type screw adjustment 105, FIG. 2A, applied to a rocking blade 100, or by having blade 100 seated in different ones of a plurality of blade slots at different angle orientations as shown at FIG. 2A.

Blade 100 may thus be "set" at one of a limited number of variable angles as shown by the double headed arrow 109A. Such adjustment moves the scraping tip of the blade 100 slightly toward or away from the rounded crown 106 at the leading edge of the collector shroud 195. Shroud 195, FIG. 5, is tilted in a downward direction in order to allow popcorn 101 removed from ceiling 102 to drop into the collector tray 107 of FIG. 2. At the low point 125 in tray 107 is the vacuum entrance 108 for the vacuum assist system of unit 150.

Please note that the forward suction end 190 of a vacuum hose 180 removes debris and acoustic material that is being scraped and dropped into collector tray 107. Hose 180 moves such debris into any suitable vacuum collector system such as for example, a Shop Vac™ 210, FIG. 1, which vacuum 210 is connected to the outlet end of hose 180 as shown by the dashed line of FIG. 1.

At this point it is believed helpful to note that additional attachments either in conjunction with the vacuum hose 180 or by themselves may readily include electrical or water or air pressure connections for additional capabilities of my system invention.

Any of these additional power source connections may be provided by a hose or leads such as hose 161 in FIG. 1. Thus, for example, hose 161 may provide a watering or misting source 162 at the foremost tip 106 of the handle 150. When a water mist is desired, as explained below, hose 161 and a set of misting jets 162, FIG. 2, are employed as a tip sprayer for misting the "popcorn".

In my method I have found that misting the ceiling section to be treated is a valuable early step. A mist of a suitable loosing agent, such as water, sprayed from misting jets 162 will soften slightly the popcorn substance. After a few seconds the mist "sets" the substance and allows its easier removal by blade 100. Hose 161, under selective user control 164 from pressurized water source 158, FIG. 1, delivers such misting solution to the set of spray tips 162 in accordance with these steps of my method.

My system 150 thereafter collects the misted and "set" acoustic substance scraped away by blade 100 via any suitable vacuum 210, FIG. 1. Vacuum 210 is connected to tray 107 by a suitable length of vacuum hose 180. Similarly, water under pressure from source 158 may be controlled by the user and control 164 to spray and clean the treated ceiling 102. Popcorn or "cottage cheese" material may thus be easily removed and trapped in a suitable vacuum bag (not shown) within vacuum 210 mostly eliminating any mess or "glue" problems of the prior art.

FIG. 5 is another perspective view of scraper unit 150 including a portion of the forward telescoping arm 105. The views of FIGS. 2 and 4 clearly show the sides of the trough portion 107 of my VACRS collection system 110. As scraper blade 100 (FIG. 2) moves along the ceiling surface 102, scraper blade 100 removes the acoustic "popcorn". Such removed acoustic ceiling substance falls into trough 107 where it is guided by the bottom and sides of trough 107 into the lowest level vacuum opening(s) 125. Please note that the telescope portion 105, FIG. 5, may be adjusted for different lengths as needed for a particular job.

It is preferable that the handle 140 be made of any suitable lightweight material so that the unit is not any heavier than absolutely necessary. Thus, as shown in FIG. 1, user controls and sources of vacuum, misting attachments and the like are kept at floor level so as to lighten the weight of handle 140. Remember that gravity which helps at floor level is a deterrent and must be overcome for ceiling work as described and claimed herein.

For ease of presentation my invention has been shown and described as a vacuum assisted system. Quite obviously the type of suction assist may vary without detracting from the power and scope of my invention. Also, the drawing and description implicitly show my scraper head 150 as partially opaque, but it may be advantageous to have shroud 195 transparent—at least partially so—in order that the user may better control the trough placement and scraper head movement across an acoustic ceiling 102 being treated.

In general then, what has not yet been provided before by the art, in order to fill a long sought for need, is a flexible, easy-to-use apparatus and method for removing popcorn ceiling material. The invention provides a novel solution to this long sought for need by featuring a uniquely shaped tool for simplicity and vacuum assisted ceiling material removal. Quite obviously, the unique handle design may favor other tool attachment uses besides the hopper and collector device 110 described and claimed herein.

My invention has been described with reference to particular examples of some preferred embodiments, it is my intention to cover all modifications and equivalents within the scope of the following claims. It is therefore requested that the following claims, which define my invention, be given a liberal interpretation commensurate with my contribution to the relevant technology.

What is claimed is:

1. A two handed force applying ceiling scraper unit allowing a user to reach aloft and scrape acoustic "popcorn" ceiling material from an acoustic ceiling, said scraper unit comprising:

a crooked elongated handle having a first forward end connected to a tray shaped trough and a second rearward end opposite said first end, with said rearward end being formed as a rocker shaped arm rest with a concave upper surface adapted to receive and conform to an underside portion of a user's arm at the user's elbow and forward of the user's elbow to the user's wrist for holding said unit during use;

a tray-shaped trough connected at the first forward end of said crooked handle with said trough having a scraper blade across a top front upper leading edge of said trough;

a vacuum opening in a lower rearward portion of said trough allowing attachment at said trough of a suction hose to be applied to the interior of said trough for removal of debris scraped from a ceiling by said scraper blade;

said arm rest at the second rearward end of said elongated handle having an upper curved concave surface substantially conforming to said underside surface portion for one of the user's arms and allowing a user to hold the ceiling scraper aloft and a pistol-like grip with an arch shaped extension over the grip located just forward of the concave surface as additional support for said handle which allows a user to apply a ceiling scraping force at said blade location on said trough with a first arm and hand; and a double bend upward offset in said handle located forward of said pistol-like grip, which upward offset includes a side projecting handle allowing the user to place a second hand on the side projecting handle to apply a force at the pistol-style grip and at said side projecting handle for said two handed force for the ceiling scraper unit.

2. The ceiling scraper in accordance with claim 1 wherein a portion of said elongated handle forward of said double bend offset area is a straight telescoping length for additional adjustment to the length and configuration of said handle.

3. The ceiling scraper in accordance with claim 1 wherein said vacuum opening is a vacuum outlet and said trough further includes a vacuum inlet with said vacuum inlet being open into the interior of said trough and said vacuum outlet being adaptable for receiving a vacuum hose connection to an external vacuum source for removing, by an applied vacuum from said external source, debris from within said trough.

4. The ceiling scraper in accordance with claim 1 wherein said unit further comprises:

a transparent shroud forming the base of said trough to allow the user to see and guide the scraper blade during a ceiling scraping maneuver.

5. The ceiling scraper of claim 1 wherein scraping said ceiling has a range of preferred angles of attack by said blade, and said unit further includes adjustability features comprising:

adjustability setting means associated with said tray-shaped trough for selecting an angle adjustment setting for said scraper blade relative to said ceiling.

6. The ceiling scraper of claim 5 wherein said adjustability setting means comprises:

skid plates rotatably attached to the upper surface of said trough for slidably engaging the surface of said ceiling for setting the angle for said tray and therefore said blade relative to said ceiling.

7. The apparatus of claim 6 wherein said skid plates further comprise:

adjustability settings in the form of a series of selectable openings for fixing the skid plates at different angles relative to said trough whereby the skid plates may be rotated and vertically oriented between the trough and the ceiling such that the trough itself is changed in angular relationship relative to said ceiling by a selective rotation of said adjustability settings on said skid plates when said skid plates are pressed against said ceiling.

* * * * *